US007382322B1

(12) United States Patent
Yang et al.

(10) Patent No.: US 7,382,322 B1
(45) Date of Patent: Jun. 3, 2008

(54) CIRCULARLY POLARIZED PATCH ANTENNA ASSEMBLY

(75) Inventors: Tsai-Yi Yang, Tainan Hsien (TW); Te-Yi Chu, Tainan Hsien (TW)

(73) Assignee: Cirocomm Technology Corp., Tainan Hsien (TW)

( * ) Notice: Subject to any disclaimer, the term of this patent is extended or adjusted under 35 U.S.C. 154(b) by 0 days.

(21) Appl. No.: 11/688,937

(22) Filed: Mar. 21, 2007

(51) Int. Cl.
*H01Q 1/38* (2006.01)

(52) U.S. Cl. ..... 343/700 MS

(58) Field of Classification Search ..... 343/700 MS, 343/846

See application file for complete search history.

(56) References Cited

U.S. PATENT DOCUMENTS 5,061,939 A * 10/1991 Nakase ..... 343/700 MS

* cited by examiner

*Primary Examiner*—Michael C Wimer

(57) ABSTRACT

A circularly polarized patch antenna assembly having a relatively compact volume includes a substrate, a radiation metal piece, a grounded metal piece and a signal-inputting body. A plurality of frequency down-conversion metal pieces in a form of elongate stripe extends from four sides of the grounded metal piece, thereby to reduce the resonant frequency. The frequency down-conversion metal pieces are adhered on the side face of the substrate, so that the frequency down-conversion metal piece on one side face is arranged diagonally with respect to the frequency down-conversion metal piece on the opposite side face. When the resonant frequency of the antenna is to be reduced, the position and the area of the frequency down-conversion metal piece can be adjusted but the increased area of the frequency down-conversion metal piece cannot be larger than a half area of the side face of the substrate. Alternatively, the length of the frequency down-conversion metal piece can be increased.

13 Claims, 9 Drawing Sheets

CIRCULARLY POLARIZED PATCH ANTENNA ASSEMBLY

BACKGROUND OF THE INVENTION

1. Field of the Invention

The present invention relates to an antenna, and in particular to a relatively compact patch antenna assembly.

2. Description of Prior Art

Nowadays, automotive satellite navigation systems rapidly become more and more popular. In addition to be combined with an in-car AV system, many kinds of GPS products are developed in which the satellite navigation system is integrated with a PDA, Notebook or mobile phone. The GPS product which is most closely related to the car owner is the portable automobile GPS. As to the car owner whose car is not originally equipped with a GPS, it is good for him/her to choose a portable automobile GPS because the price thereof is reasonable and the portability thereof allows to be used out of the car. Further, even the car owner buys a new car in the future, he/she can still use this portable automobile GPS.

When the GPS is integrated with various electronic products such a PDA, Notebook or mobile phone, a GPS signal-receiving antenna assembly is necessarily built in the electronic device. With reference to FIG. 1, the antenna comprises a substrate 1A, a radiation metal pieces 2A, a grounded metal pieces 3A and a signal-inputting body 4A. The substrate of this kind of antenna is made of ceramic materials having a high dielectric constant (8-150). The resonant frequency of the circularly polarized patch antenna is 1575.42 MHz.

Recently, since the volume of the PDA or mobile phone is made more and more compact, when the GPS is to be integrated with the PDA or mobile phone, a phenomenon may occurs that the existing circularly polarized patch antenna shown in FIG. 1 cannot be mounted therein. Moreover, it is difficult for this kind of circularly polarized patch antenna to further reduce the size thereof because the area of the radiation metal piece 2A connected on the surface of the substrate 1A will be reduced accordingly when the volume of the substrate 1A is reduced. On the condition that the substrate dielectric constant is not changed, once the area of the radiation metal piece 2A is reduced, the resonant frequency of the antenna will rise to depart from the frequency band that can be received by the GPS, which causes the GPS unable to receive the signals. Although the antenna can be mounted in a small-volume PDA or mobile phone, the function of receiving satellite signals may not be obtained. Therefore, it is an important issue in the field of the present invention to reduce the area and volume of the circularly polarized patch antenna.

SUMMARY OF THE INVENTION

The present invention is characterized in that the side face of the patch antenna is additionally provided with a frequency down-conversion metal piece, so that the volume of the circularly polarized patch antenna having the same dielectric constant can be reduced by 10% to 50% while maintaining the original resonant frequency and circularly polarized property.

In order to achieve the above objects, the present invention provides a circularly polarized patch antenna assembly, in which a plurality of frequency down-conversion metal pieces extends from the grounded metal piece. The frequency down-conversion metal pieces are adhered on the side face of the substrate made of dielectric materials, so that the frequency down-conversion metal piece on one side face is arranged diagonally with respect to the frequency down-conversion metal piece on the opposite side face. When the resonant frequency of the antenna is to be reduced, the position and the area of the frequency down-conversion metal piece can be adjusted but the increased area of the frequency down-conversion metal piece cannot be larger than a half area of the side face of the substrate. Alternatively, the length of the frequency down-conversion metal piece can be increased.

DETAILED DESCRIPTION OF THE INVENTION

The technical contents and detailed description of the present invention will be explained with reference to the accompanying drawings.

Figure 1:
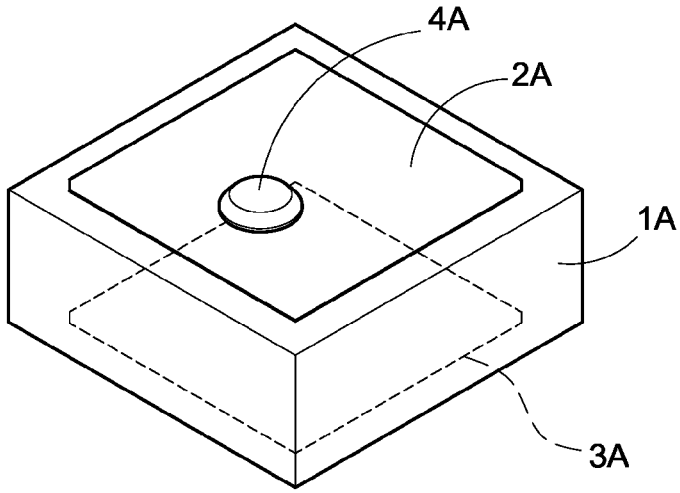
FIG.1 (Prior Art)
FIG. 1 is a schematic view showing a conventional circularly polarized patch antenna assembly.
Figure 2:
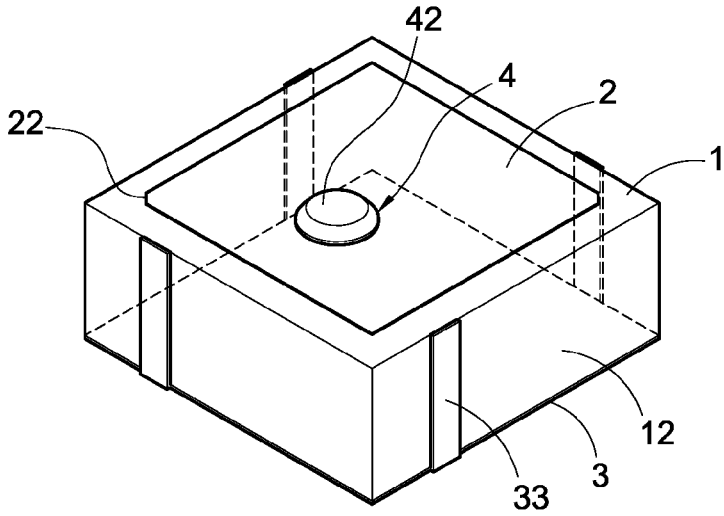
FIG. 2 is a perspective view showing the patch antenna assembly of the first embodiment of the present invention.
Figure 3:
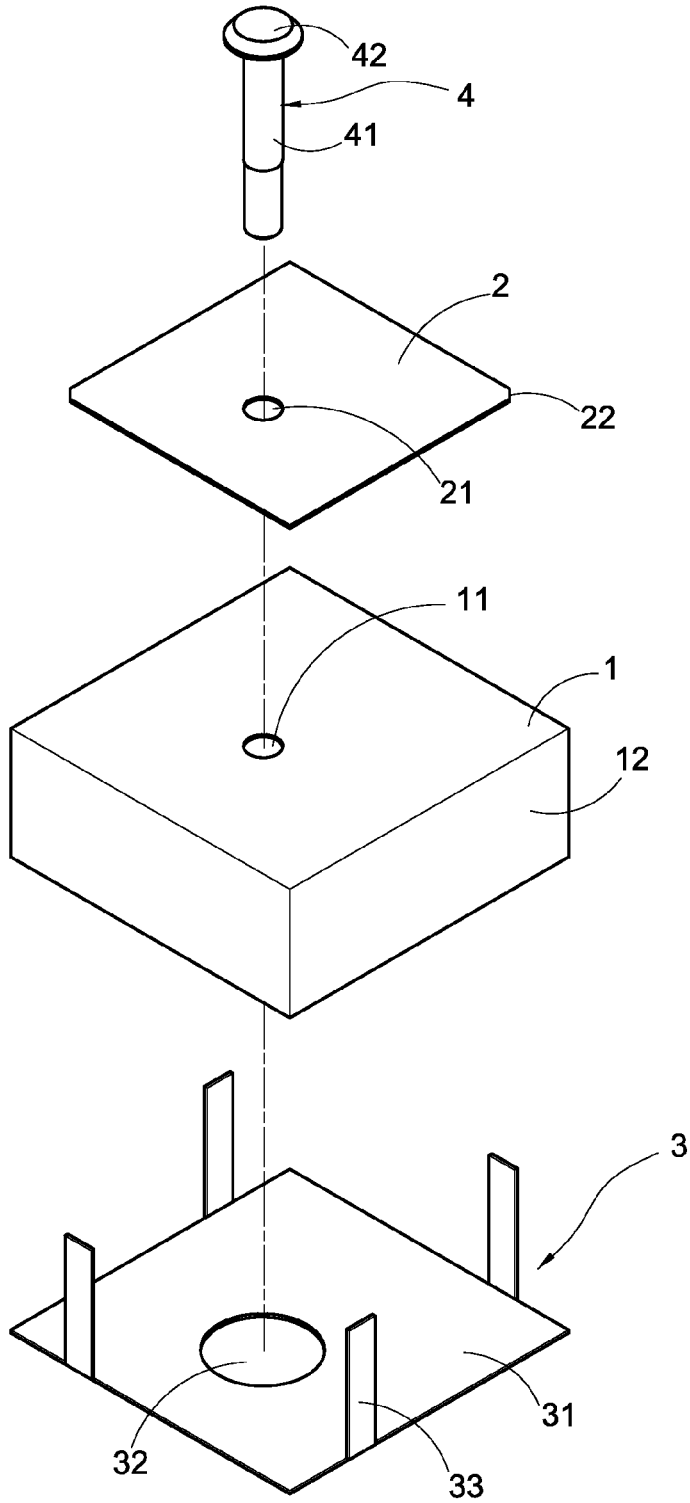
FIG. 3 is an exploded view showing the patch antenna assembly of the first embodiment of the present invention.

FIG. 2 is a perspective view showing the patch antenna assembly of the first embodiment of the present invention, and FIG. 3 is an exploded view showing the patch antenna assembly of the first embodiment of the present invention. The miniaturized circularly polarized patch antenna assembly shown in these figures includes a substrate 1, a radiation metal piece 2, a grounded metal piece 3 and a signal inputting body 4. The above components are combined to form a miniaturized antenna assembly that can be built and used in a portable GPS satellite navigation system.

The above substrate 1 is a cubical body and made of ceramic materials having a high dielectric constant (8-150). The upper surface of the substrate has a penetrating hole 11 for penetrating the substrate 1.

The radiation metal piece 2 is a square sheet provided on the surface of the substrate 1, and provided thereon with a through hole 21 corresponding to the above penetrating hole 11. The radiation metal piece 2 has four corners. Any two diagonal chamfers 22 can form a dextrorotary or levorotary circularly polarized patch antenna. In the figures, the chamfers 22 on the radiation metal piece 2 are provided in the right-upper portion and the corresponding left-lower portion thereof. Therefore, it belongs to a dextrorotary circularly polarized patch antenna.

Figure 4:
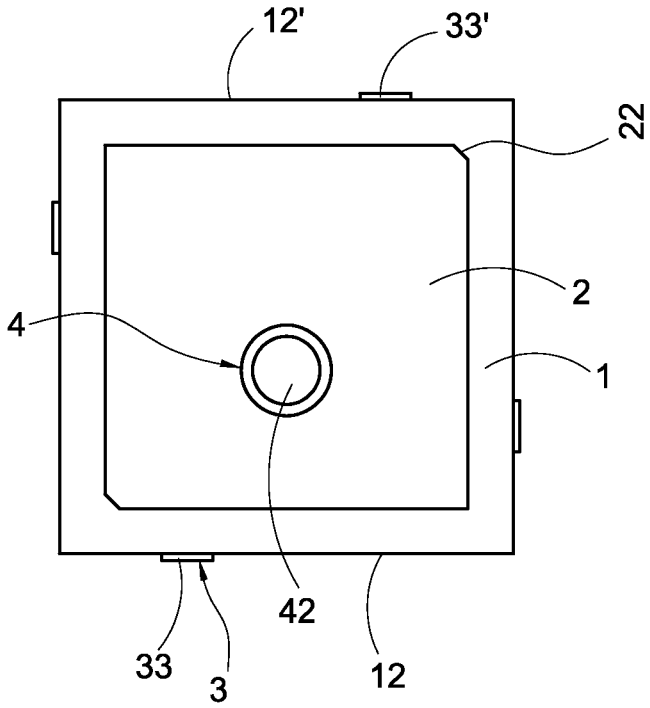
FIG. 4 is a top view showing the patch antenna assembly of the first embodiment of the present invention.

With reference to FIG. 4, the grounded metal piece 3 is a square sheet and has a sheet 31 connected to the bottom of the substrate 1. The sheet 31 has a penetrating hole 32 whose inner diameter is larger than that of the penetrating hole 11. Further, a plurality of frequency down-conversion metal pieces in a form of an elongated sheet extends from four sides of the sheet 21. The frequency down-conversion metal piece 33 is adhered onto the side face 12 of the substrate 1, so that the frequency down-conversion metal piece 33 on the one side face 12 is diagonally arranged with respect to the frequency down-conversion metal piece 33' on the opposite side face 12'. In this figure, the frequency down-conversion metal piece 33 is used to reduce the resonant frequency of the antenna. When the volume of the substrate 1 of the antenna is reduced, the area of the radiation metal piece 2 is also reduced, which causes the increase of the resonant frequency of the antenna. Therefore, the frequency down-conversion metal piece 33 can be used to recover the resonant frequency of the antenna to a desired frequency band.

The signal-inputting body 4 is formed into a T-lettered shape and has a pillared solid or tubular hollow conductor body 41. One end of the body 41 has a head portion 42. After the body 41 of the signal-inputting body 4 penetrates through the penetrating hole 11, the through hole 21 and the penetrating hole 32, the head portion 42 at one end of the body 41 is electrically connected with the radiation metal piece 2. When the radiation metal piece 2 receives signals, the signal-inputting body 4 forms a signal-inputting point.

Owing to the design of the frequency down-conversion metal piece 33, the volume of the antenna made of the material having the same dielectric constant can be reduced by 10% to 50%. Therefore, the thus-formed antenna can be built in the current compact portable electronic device.

Figure 5:
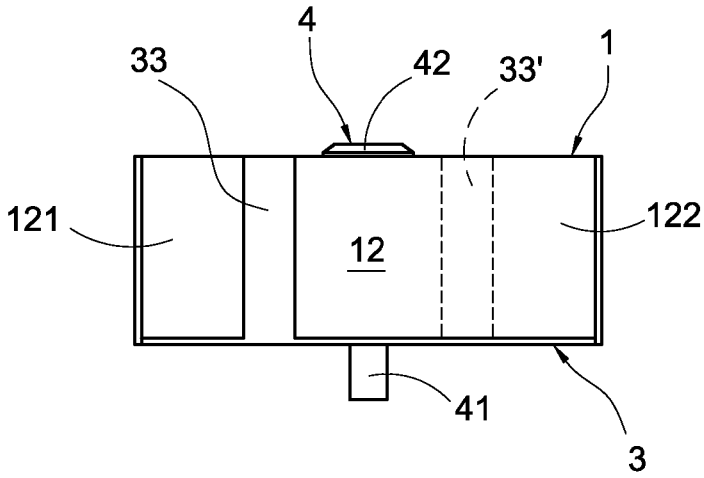
FIG. 5 is a side view showing the patch antenna assembly of the first embodiment of the present invention.

FIG. 4 and FIG. 5 are a top view and a side view of the patch antenna of the present invention. As shown in these figures, when the chamfers 22 of the radiation metal piece 2 on the substrate 1 of the patch antenna are arranged in the right-upper portion and the corresponding left-lower portion thereof, the frequency down-conversion metal piece 33 extending from the grounded metal piece 3 is arranged on the left side face 121 of the side face 12, thereby to form a dextrorotary circularly polarized patch antenna for receiving and transmitting a dextrorotary circularly polarized electronic wave.

When the resonant frequency of the antenna is to be further reduced, the area of the frequency down-conversion metal piece 33 can be increased. However, the increased area of the frequency down-conversion metal piece 33 cannot be larger than a half area of the side face 12 of the substrate 1. If the area of the frequency down-conversion metal piece 33 is larger than a half area of the side face of the substrate 1, the radiation gain and efficiency of the antenna will be seriously affected.

Figure 6:
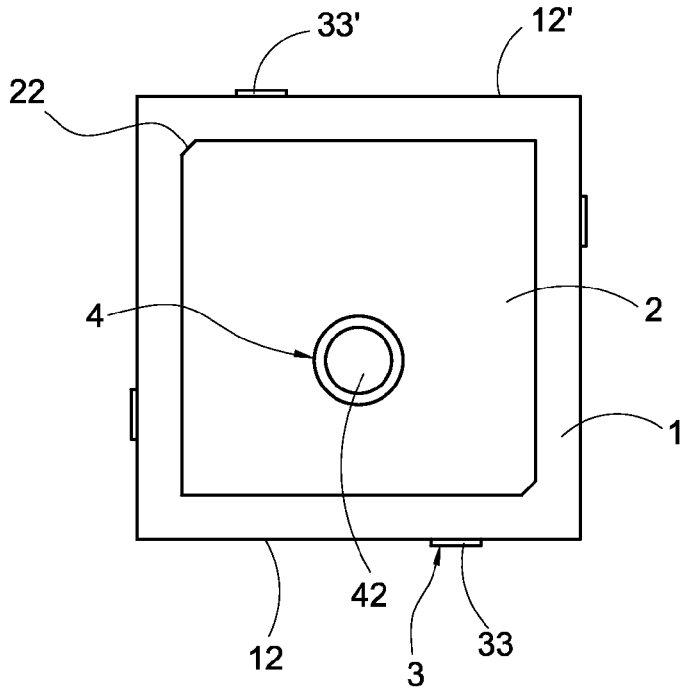
FIG. 6 is a top view showing the patch antenna assembly of the second embodiment of the present invention.
Figure 7:
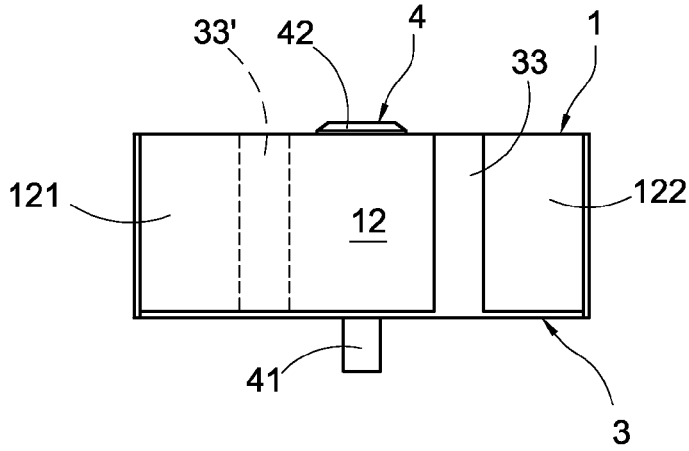
FIG. 7 is a side view showing the patch antenna assembly of the second embodiment of the present invention.
Figure 8A:
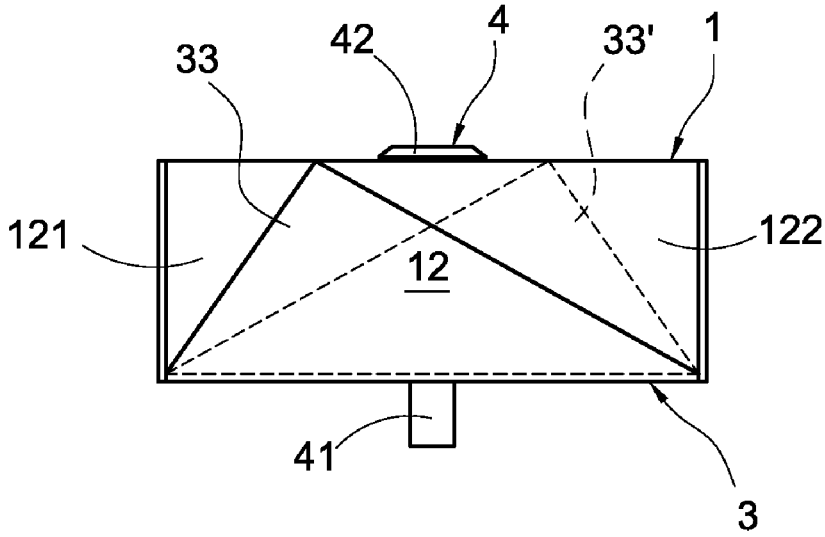
FIG. 8 is a schematic view showing the patch antenna assembly of the third embodiment of the present invention.
Figure 8B:
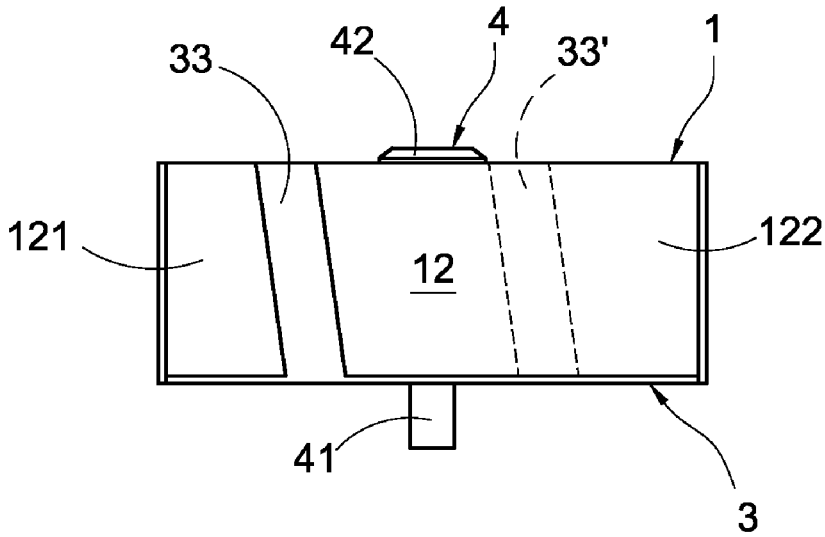
Figure 8C:
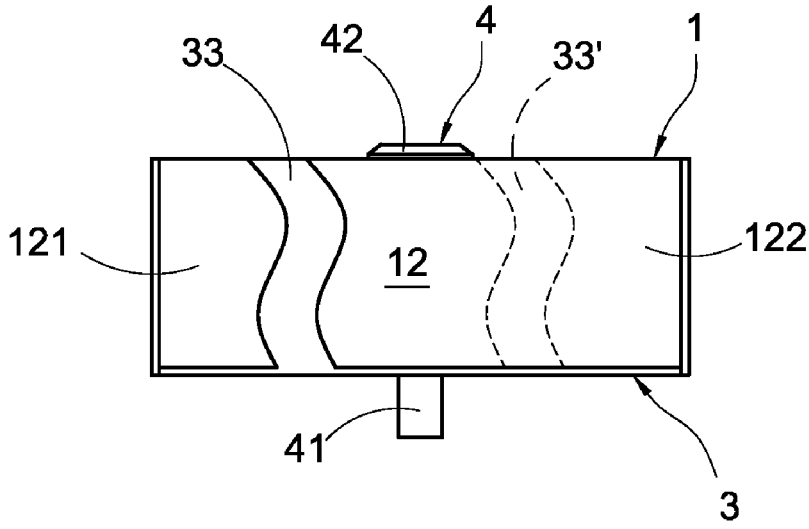
Figure 8D:
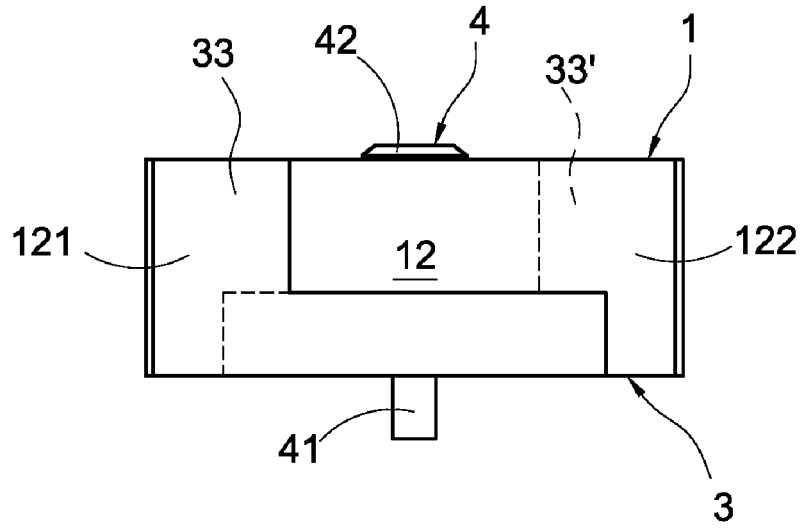

FIG. 6 and FIG. 7 are a top view and a side view of the patch antenna of the second embodiment of the present invention. As shown in these figures, when the chamfers 22 of the radiation metal piece 2 on the substrate 1 of the patch antenna are arranged in the left-upper portion and the corresponding right-lower portion thereof, the frequency down-conversion metal piece 33 extending from the grounded metal piece 3 is arranged on the right side face 122 of the side face 12, thereby to form a levorotary circularly polarized patch antenna for receiving and transmitting a levorotary circularly polarized electronic wave.

When the resonant frequency of the antenna is to be reduced, the area of the frequency down-conversion metal piece 33 can be increased. However, the increased area of the frequency down-conversion metal piece 33 cannot be larger than a half area of the side face 12 of the substrate 1. If the area of the frequency down-conversion metal piece 33 is larger than a half area of the side face of the substrate 1, the radiation gain property of the antenna will be seriously affected.

FIG. 8 is a schematic view showing the patch antenna assembly of the third embodiment of the present invention. As shown in this figure, the frequency down-conversion metal piece 33 of the circularly polarized patch antenna shown in FIGS. 8A to 8D can be formed into any one of triangle, oblique stripe, wave, L-lettered shape or the like. By means of coating or adhesion, the frequency down-conversion metal piece 33 can be adhered onto the left side face 121 or right side face 122 of the side face 12 of the substrate 1, or extending from the left side face 121 to the right side face 122, or vice versa. However, the coated or adhered area of the frequency down-conversion metal piece 33 cannot be larger than a half area of the side face 12.

Figure 9:
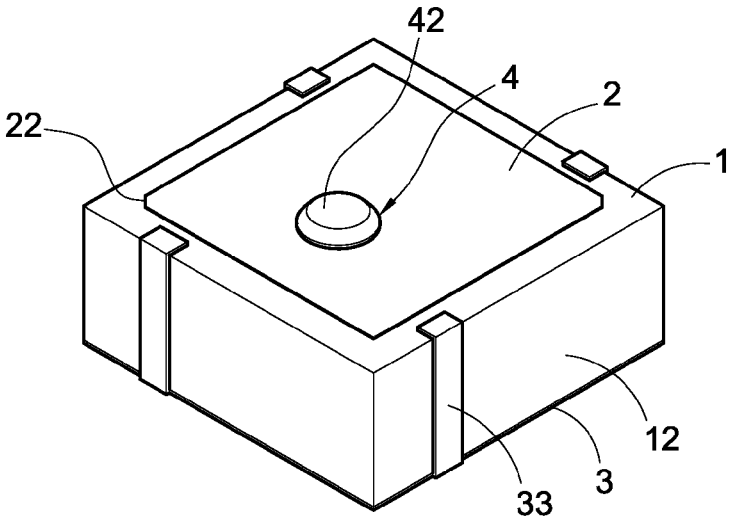
FIG. 9 is a schematic view showing the patch antenna assembly of the fourth embodiment of the present invention.

FIG. 9 is a schematic view showing the patch antenna assembly of the fourth embodiment of the present invention. As shown in the figure, when the resonant frequency of the antenna is to be reduced, in addition to increase the area of the frequency down-conversion metal piece 33, the length thereof can be alternatively increased. The length of the frequency down-conversion metal piece 33 can be extended on the surface substrate 1 but not contact with the radiation metal piece 2.

Figure 10A:
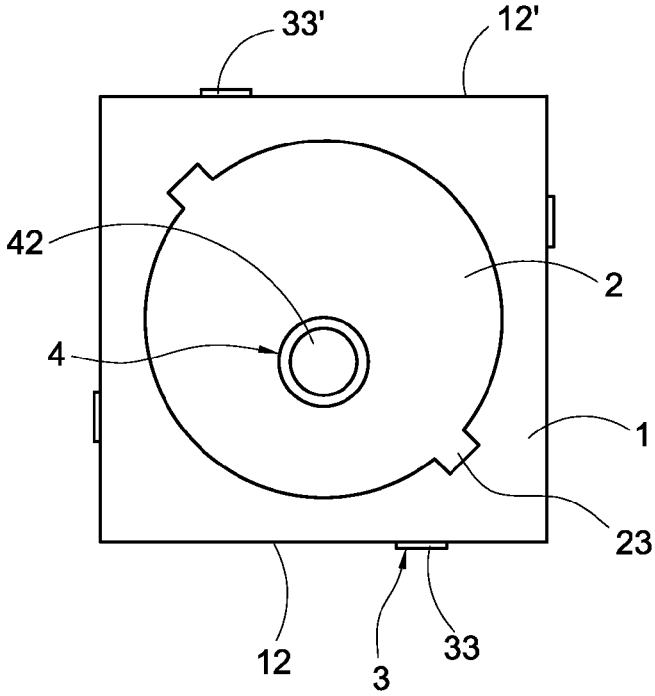
FIGS. 10A and 10B are schematic views showing the patch antenna assembly of the fifth embodiment of the present invention.
Figure 10B:
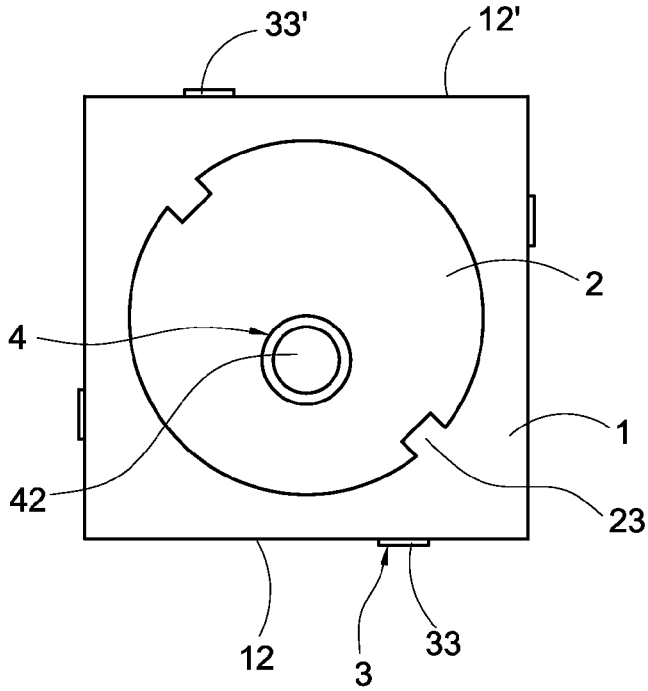

FIGS. 10A and 10B are schematic views showing the patch antenna assembly of the fifth embodiment of the present invention. As shown in the figures, the radiation metal piece 2 is formed into a circular shape. The circumference of the radiation metal piece 2 is provided with bumps or notches 23 arranged in the left-upper portion and the corresponding right-lower portion thereof. The frequency down-conversion metal piece 33 extending from the grounded metal piece 3 is provided on the right side face 122 of the side face 12, thereby to form a levorotary circularly polarized patch antenna for receiving and transmitting a levorotary circularly polarized electronic wave.

Figure 11:
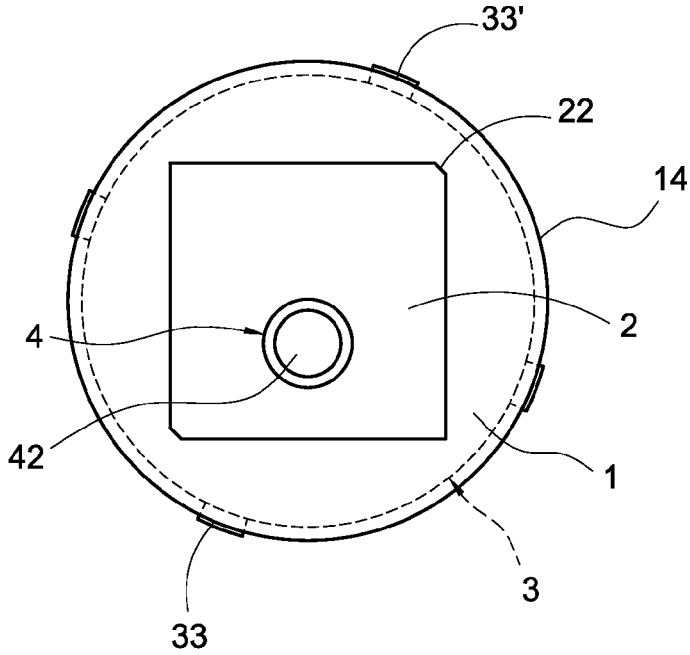
FIG. 11 is a schematic view showing the patch antenna assembly of the sixth embodiment of the present invention.

FIG. 11 is a schematic view of the patch antenna of the sixth embodiment of the present invention. As shown in this figure, when the substrate 1 and the grounded metal piece 3 are both formed into a circular shape, and the chamfers 22 of the radiation metal piece 2 on the surface are arranged in the right-upper portion and the corresponding left-lower portion thereof, the frequency down-conversion metal piece 33 extending from the grounded metal piece 3 is arranged on the circumferential surface 14, thereby to form a dextrorotary circularly polarized patch antenna for receiving and transmitting a dextrorotary circularly polarized electronic wave.

Figure 12A:
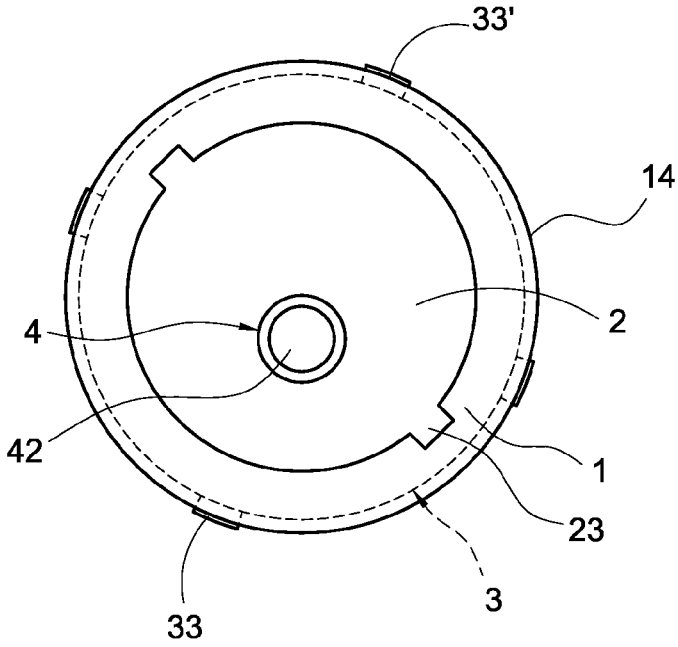
FIGS. 12A and 12B are schematic views showing the patch antenna assembly of the seventh embodiment of the present invention.
Figure 12B:
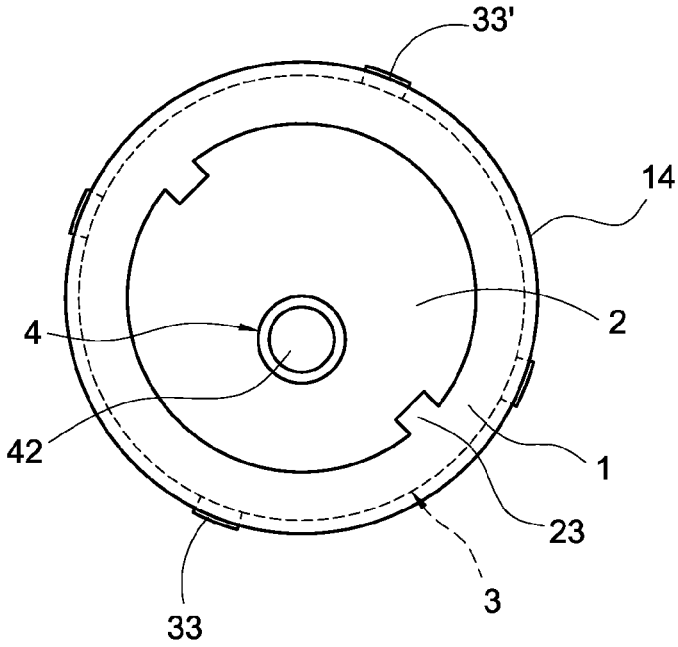

FIG. 12A and FIG. 12B are schematic views of the patch antenna of the seventh of the present invention. As shown in theses figures, when the substrate 1, the radiation metal piece 2 and the grounded metal piece 3 of the patch antenna are formed into a circular shape, and the circumference of the radiation metal piece 2 is provided with bumps or notches 23 in the left-upper portion and the corresponding right-lower portion thereof, the frequency down-conversion metal piece 33 extending from the grounded metal piece 3 is provided on the circumferential surface 14, thereby to form a levorotary circularly polarized patch antenna for receiving and transmitting a levorotary circularly polarized electronic wave.

Although the present invention has been described with reference to the foregoing preferred embodiments, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A circularly polarized patch antenna assembly, comprising:

a substrate having a penetrating hole for penetrating the substrate;

a radiation metal piece connected on the surface of the substrate and provided with a through hole corresponding to the penetrating hole, the radiation metal piece having four corners, any two diagonal corners provided with two symmetrical chamfers;

a grounded metal piece connected to the bottom of the substrate and having a sheet thereon, the sheet having a penetrating hole whose inner diameter is larger than that of the penetrating hole, a plurality of frequency down-conversion metal pieces extending from four sides of the sheet, the frequency down-conversion metal pieces adhered on the side face of the substrate, the frequency down-conversion metal piece on one side face arranged diagonally with respect to the frequency down-conversion metal piece on the opposite side face; and a signal-inputting body penetrating the penetrating hole, through hole and penetrating hole and electrically connected with the radiation metal piece to form a signal-inputting point.

2. The circularly polarized patch antenna assembly according to claim 1, wherein the frequency down-conversion metal piece is formed into any one an elongated sheet, triangle, oblique strip, wave, L-lettered shape.

3. The circularly polarized patch antenna assembly according to claim 1, wherein when the frequency down-conversion metal piece is used to reduce the resonant frequency of the antenna, the area of the frequency down-conversion metal piece is able to be increased, the area extends from the left side face to the right side face or extends from the right side face to the left side face, the area is not larger than a half area of the side face of the substrate.

4. The circularly polarized patch antenna assembly according to claim 1, wherein when the frequency down-conversion metal piece is used to reduce the resonant frequency of the antenna, the length of the frequency down-conversion metal piece is able to be extended onto the surface of the substrate but not connect with the radiation metal piece.

5. The circularly polarized patch antenna assembly according to claim 1, wherein two mutually symmetrical chamfers on the radiation metal piece are arranged in the right-upper portion and the corresponding left-lower portion thereof, the frequency down-conversion metal piece extending from the grounded metal piece is arranged on the left side face of the side face, thereby to form a dextrorotary circularly polarized patch antenna for receiving and transmitting a dextrorotary circularly polarized electronic wave.

6. The circularly polarized patch antenna assembly according to claim 1, wherein two mutually symmetrical chamfers on the radiation metal piece are arranged in the left-upper portion and the corresponding right-lower portion thereof, the frequency down-conversion metal piece extending from the grounded metal piece is arranged on the right side face of the side face, thereby to form a levorotary circularly polarized patch antenna for receiving and transmitting a levorotary circularly polarized electronic wave.

7. The circularly polarized patch antenna assembly according to claim 1, wherein the signal-inputting body is formed into a T-lettered shape and has any one of a pillared solid and a tubular hollow conductor body, one end of the body has a head portion.

8. The circularly polarized patch antenna assembly according to claim 1, wherein the substrate is formed into a cubical or circular shape.

9. The circularly polarized patch antenna assembly according to claim 1, wherein the radiation metal piece is formed into a square or circular sheet.

10. The circularly polarized patch antenna assembly according to claim 1, wherein the grounded metal piece is formed into a square or circular sheet.

11. The circularly polarized patch antenna assembly according to claim 1, wherein when the radiation metal piece is formed into a circular shape, the circumference of the radiation metal piece is provided with any one of bumps and notches in the left-upper portion and the corresponding right-lower portion thereof.

12. The circularly polarized patch antenna assembly according to claim 1, wherein when the radiation metal piece is formed into a circular shape, the circumference of the radiation metal piece is provided with any one of bumps and notches in the right-upper portion and the corresponding left-lower portion thereof.

13. The circularly polarized patch antenna assembly according to claim 1, wherein when the substrate is formed into a circular shape, the frequency down-conversion metal piece extending from the grounded metal piece is arranged on the circumferential surface.

* * * * *